United States Patent [19]

Neely

[11] 4,141,056

[45] Feb. 20, 1979

[54] TENNIS COURT FLOODLIGHTING SYSTEM

[76] Inventor: Samuel M. Neely, 8636 Graham Ave., Los Angeles, Calif. 90002

[21] Appl. No.: 805,826

[22] Filed: Jun. 13, 1977

[51] Int. Cl.[2] ..... F21V 7/00

[52] U.S. Cl. ..... 362/1; 362/145; 362/249; 362/431; 273/95 H

[58] Field of Search ..... 273/29 R, 95 H; 362/33, 362/145, 219, 220, 225, 240, 249, 252, 371, 431, 1; 272/3

[56] References Cited

U.S. PATENT DOCUMENTS

| | | | |
|---|---|---|---|
| 1,404,149 | 1/1922 | Short | 273/29 R |
| 2,645,705 | 7/1953 | Rutledge | 362/249 |
| 2,694,573 | 11/1954 | Walker | 362/1 X |
| 3,123,308 | 3/1964 | Franck | 362/225 X |
| 3,375,362 | 3/1968 | Klippert | 362/33 |
| 4,004,805 | 1/1977 | Chen et al. | 273/29 R |

*Primary Examiner*—Peter A. Nelson
*Attorney, Agent, or Firm*—Sellers and Brace

[57] ABSTRACT

A floodlighting system for one or more tennis courts utilizing a pair of high-level floodlamp supporting structures adjacent a diagonally related set of corners of the perimeter zone of a tennis court. The lamps on each support are directed onto the adjacent back court and service box of a related court and uniquely aimed to be highly effective in illuminating the advance face of the ball with increasing light intensity as a ball in flight approaches a receiving player. The height of the lamps together with the small included angle of its beam greatly minimizes if not entirely avoids glare in the player's eyes. Adjacent courts are effectively and efficiently illuminated by lamps supported on a common pole located at the junction of a contiguous pair of court playing areas.

11 Claims, 3 Drawing Figures

FIG. 1.
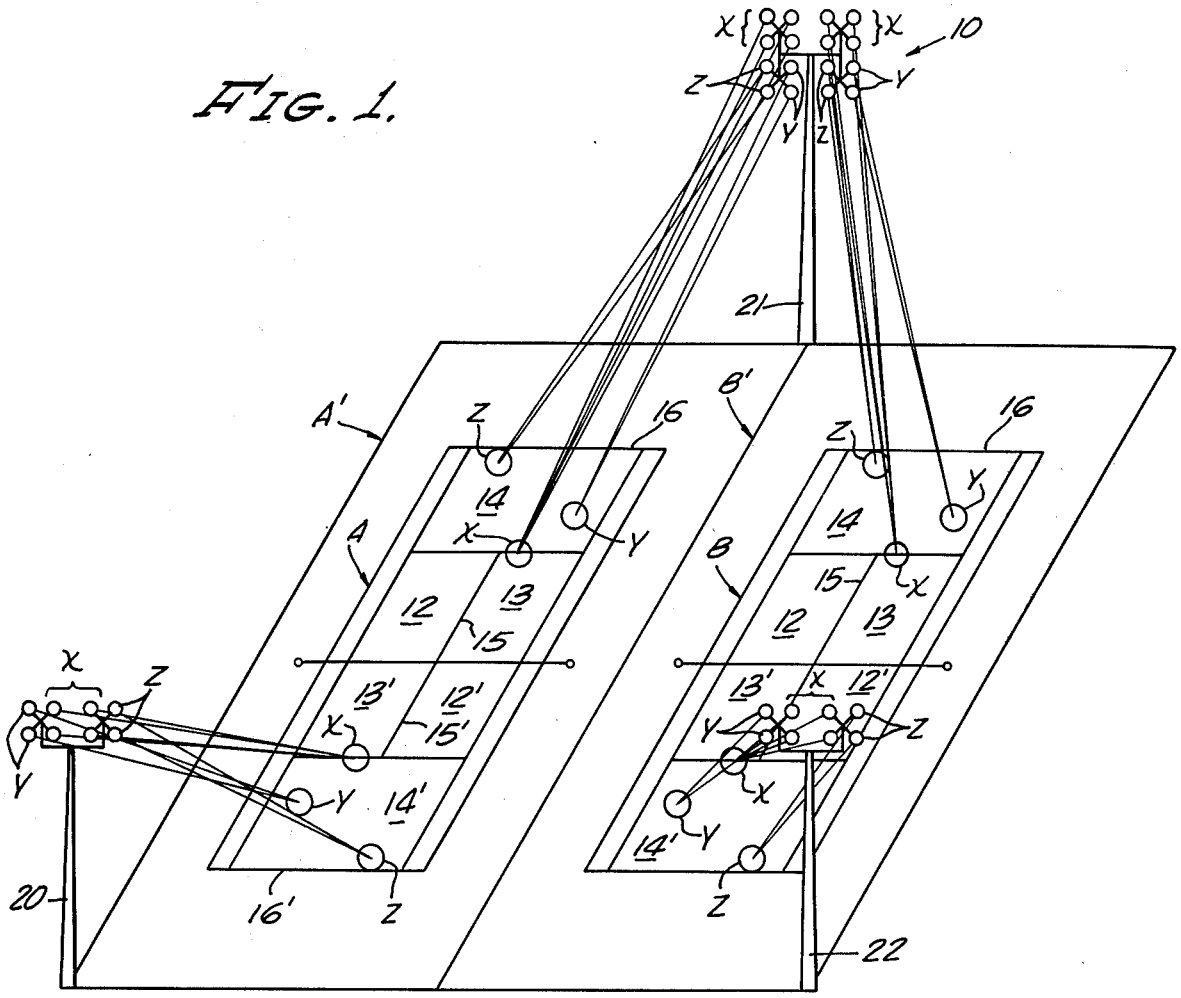
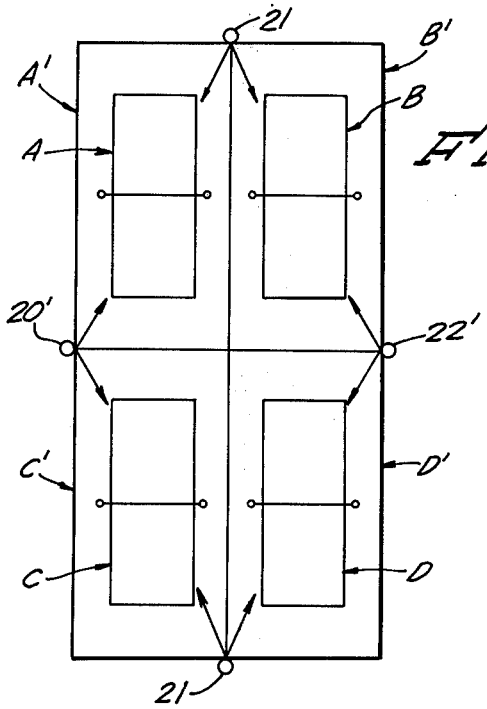
FIG. 2.
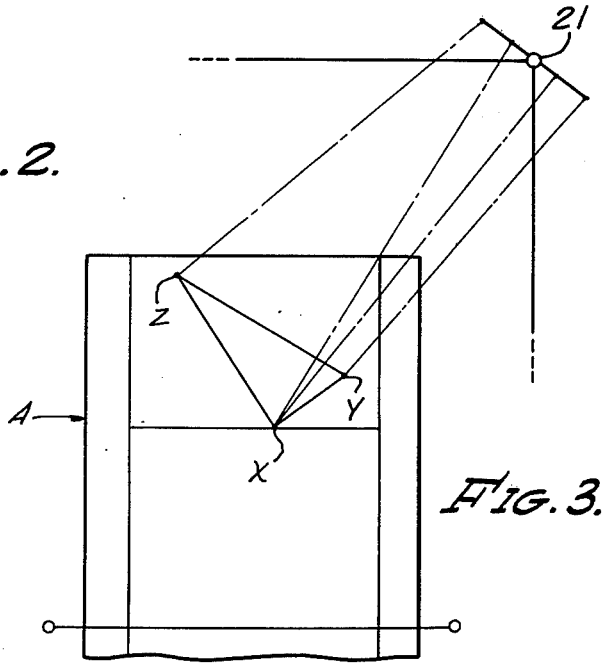
FIG. 3.

TENNIS COURT FLOODLIGHTING SYSTEM

This invention relates to floodlighting systems, and more particularly to a unique floodlighting system utilizing two lamp support structures at diagonally opposed corners of a tennis court playing area and constructed to avoid eye glare and providing greatly improved efficiency and lighting intensity on the advance face of a ball in play.

Heretofore, it has been the common if not the universal practice to illuminate tennis courts for night play from floodlighting structures arranged along the opposite lateral sides of the playing area in the belief that this was the most effective and satisfactory mode of illuminating both the court and the ball in flight. Typically, three or four poles have been employed to support the lamps located along the opposite sides of the playing area and positioned generally opposite and along that portion of the border between the back court and the service box of the court. For maximum effectiveness, it has been conventional practice to locate the lamps 20 to 30 feet above the court. This floodlighting practice illuminates the upper lateral sides of a ball in play but provides extremely poor and inadequate lighting on the advance face and leaves the underside of the ball substantially un-illuminated. Additionally, the advance lower side of a ball in flight is very poorly illuminated and this illumination decreases rapidly as the ball enters the back court area and the area contiguous to or behind the base line of the receiving player. The problem is further complicated by the fact that if a player glances to either side of the longitudinal axis of the court his eyes encounter serious glare from the lamps on that side of the court. It is therefore readily apparent why players find night play not only difficult but extremely tiring if not harmful to the eyes.

The present invention provides a greatly improved floodlighting system for tennis courts utilizing one half the number or less of floodlight support structures and foundations therefor. All floodlamps are supported on not more than one pair of high-level supports for each court and these are located adjacent diagonally related corners of the playing area. Selected ones of the lamps on each support are aimed at specific different areas of the adjacent court end zone. Typically, the lamps on a given support are divided into three groups aimed at specific target points of the back court and the adjacent end of the service box with the maximum number of lamps being aimed generally at the junction of the center line of the service box with the back court. Other of the lamps are aimed generally on two diagonally related corners of the adjacent back court. By this arrangement assurance is provided that the advance side of the ball is illuminated with increasing intensity as it approaches a receiving player from light emanating from the rear of the player. Moreover, the high level of the light source at both ends of the field and the fact that it is located rearwardly of the playing area enables the player to turn in substantially any direction typically employed in play without experiencing glare or discomfort from the light source at either end of the field.

Accordingly, it is a primary object of this invention to provide a unique and greatly improved floodlighting system for tennis courts utilizing a high level set of floodlamps positioned rearwardly of the players.

Another object of the invention is the provision of an improved floodlighting system for tennis courts utilizing two sets of floodlights supported at one diagonally related pair of corners of the playing area with the lamps of each set directed onto the adjacent end zone of the court.

Another object of the invention is the provision of an improved floodlighting system for tennis courts wherein the flood lamps are located rearward of the players out of the normal line of sight and effective to increase the lighting intensity on the advance face of the ball as it approaches a receiving player.

Another object of the invention is the provision of a floodlighting system for a plurality of contiguous tennis courts utilizing a minimum of floodlamp support structures located at selected adjacent corners of the playing area of contiguous courts and using a separate set of lamps directed onto the adjacent end zones of a related court.

These and other more specific objects will appear upon reading the following specification and claims and upon considering in connection therewith the attached drawing to which they relate.

Referring now to the drawing in which a preferred embodiment of the invention is illustrated:

FIG. 1 is a perspective view of a pair of side-by-side tennis courts equipped with the invention floodlighting system and showing the aiming areas of the various flood lamps;

FIG. 2 is a top plan view showing four tennis courts arranged in a quadrangle and the position of the supports for the four groups of floodlamps; and FIG. 3 is a fragmentary plan view of one end of a tennis court and its adjacent playing area and illustrating more clearly the position of the floodlamps and the general axes of their beams.

Referring initially more particularly to FIG. 1, there is shown an illustrative embodiment of an invention floodlighting system, designated generally 10, as installed to floodlight a pair of side-by-side tennis courts A, B each surrounded by a conventional playing area A′, B′. The corresponding areas of the two halves of each court will be designated by the same numeral but distinguished by the addition of a prime. These end halves include service boxes 12 and 13 and a back court 14. The service boxes are separated from one another by the center line 15 and the transverse end edge of the back court is known as the base line 16.

A single court, such as A, utilizes a pair of floodlamp supporting structures 20, 21 preferably 45 feet tall thereby supporting the lamps above the area viewed by the players. If a pair of courts are located side by side, as courts A and B, the two courts are floodlighted by a total of three floodlamp supporting structures 20, 21, 22, pole 21 being located at the contiguous corners of playing areas A′ B′ and poles 20 and 22 being located at the remotely spaced corners of these playing areas at the other ends thereof. Pole 20 supports identical sets of floodlamps one of which is utilized to floodlight court A and the other of which is utilized to floodlight the adjacent end of court B.

Poles 20, 22 are here illustrated as supporting three sets of floodlamps X, Y and Z aimed to illuminate the area surrounding the respective target areas X, Y and Z on the adjacent end of the tennis court. To be noted is the fact that area X is illuminated by four floodlamps here shown as located closest to the axis of support 20, whereas area Y is illuminated by the two left-hand floodlamps Y, Y and target area Z is illuminated by the two right-hand floodlamps Z, Z. The center of target area X is located generally along the dividing line between service box 13' and back court 14' and slightly to one side of the service box center line 15'.

Floodlamp support 21 mounts double the number of floodlamps and these are shown arranged on brackets on the top of this support in the general manner illustrated in FIG. 1. The four floodlamps X in the upper left-hand corner are aimed to illuminate the target area X between service box 13 and back court 14 of tennis court A whereas the four floodlamps X in the upper right-hand corner are aimed to illuminate target area X at the adjacent end of tennis court B. Similarly the two left-hand floodlamps Z in the lower left corner are aimed to illuminate area Z in court 14 and the two lamps Y on the right of the lower left-hand corner are aimed to illuminate area Y of court 14. It will be understood that the number and size of the lamps may vary but it is desirable that the lighting intensity on the respective target areas X, Y and Z be approximately 20 foot candles.

Typical coordinants for the axes of the three aiming areas X, Y and Z are as follows: The center of area X is located approximately 14 feet inwardly from the right hand exterior border of court A and on the division line between service box 13 and back court 14; the center of area Y is located approximately eight feet inwardly from the right-hand edge of court A and 12 and one half feet forwardly of base line 16; and the center of area Z is located ten feet inwardly from the left hand border of court A and two feet inwardly from base line 16.

If only a single court is to be lighted, as court A, then lamp support 21 will be replaced by a duplicate of lamp support 20. If, on the other hand, four courts are located in a quadrangle as depicted in FIG. 2, then a pair of identical floodlamps supports 21, 21 will be located at the opposite ends of the center lines dividing the four playing areas A', B', C', D'; and lamps supports 20', 22' will be similar to supports 21 except that the floodlamps will be aimed at more divergent angles as indicated by the arrows emanating from supports 20', 22', and properly oriented to illuminate respective aiming areas X, Y and Z on the adjacent ends of the related tennis courts.

If more than two courts are arranged side-by-side as courts A and B in FIG. 2, then duplicates of the floodlamps represented on support 21 are employed at the junctions between the diagonally related corners of adjacent playing areas, and supports 20' and 22' are employed as shown except that only half as many lamps are needed because courts C and D are not present.

FIG. 3 is a fragmentary showing of one end of court A and provides a clearer understanding of the fact that the floodlamps are not only located at a high level well above the normal line of view of the players but, additionally and importantly, the fact that the lamps are offset rearwardly and to either side of the court. For these reasons, the players seldom if ever, have occasion to look in the vicinity of the lighting source with the result that they are not affected by glare and can have the benefit of a high level of lighting intensity.

It will also be apparent from the foregoing that the floodlamps are directed downwardly directly in front of the player at the adjacent end of the court and not onto the far end of the court. In consequence, a player cannot look into a lamp at the opposite end of the court from a position inside the beam cone of that lamp. The high level of the light sources provides general illumination for the entire court but concentrates the bulk of the light on the adjacent end zone with the result that the advance face of the ball is illuminated with light of increasing intensity as a ball approaches the receiving player. These and other unique features of the invention lighting system cooperate in providing a highly superior illuminating system for one or more tennis courts.

While the particular tennis court floodlighting system herein shown and disclosed in detail is fully capable of attaining the objects and providing the advantages hereinbefore stated, it is to be undertood that it is merely illustrative of the presently preferred embodiment of the invention and that no limitations are intended to the detail of construction or design herein shown other than as defined in the appended claims.

I claim:

1. That improvement in floodlighting a tennis court surrounded by a conventional playing area, playingarea comprising:

means for supporting first and second sets of floodlamps approximately 40 feet or more above the tennis court and adjacent a respective one of a pair of remotely spaced diagonally related corners of said playing area;

said first and second sets of floodlamps being directed onto a plurality of areas of the adjacent back court of said tennis court and the contiguous portion of the adjacent service box and cooperating to increase the lighting intensity on the advance face of a tennis ball in play as it approaches the ball receiving player.

2. That improvement defined in claim 1 characterized in that each of said floodlamps is positioned to cast a light beam onto the adjacent end of said tennis court and the major portions of which light beams are directed onto the end half of said court close to the source of the light beams.

3. That improvement defined in claim 1 characterized in that said first and second sets of flood lamps include not less than three groups of floodlamps, light beams of one of which groups are directed to illuminate the area embracing the junction of the adjacent back court and the adjacent service courts, and the light beams of two of which floodlamps groups are directed toward a respective end portion of the adjacent back court.

4. That improvement defined in claim 1 characterized in that said first and second sets of floodlamps each include one major group and two minor groups of floodlamps, said major group of floodlamps casting a group light beam having an axis intersecting the adjacent end of said tennis court adjacent the junction of the service courts and the back court, said two minor floodlamp groups casting a respective group of light beams having an axis intersecting a respective half of the adjacent back court.

5. That improvement defined in claim 4 characterized in that the axis of the combined beams of said two minor groups of floodlamps intersect a respective one of the diagonally opposed corners of the adjacent back court.

6. That improvement defined in claim 1 characterized in that the combined light beams of said first and second sets of floodlamps are concentrated on the respective adjacent end halves of said tennis court with the major portion of the light being directed onto the adjacent back court and the adjacent portion of the contiguous service box.

7. That improvement in floodlighting a plurality of contiguous tennis courts surrounded by a conventional rectangular playing area, comprising:

means supporting at least one set of floodlamps approximately 40 feet or more above said tennis courts and adjacent a respective one of a pair of remotely spaced diagonally related corners of each of said playing areas;

each set of said floodlamps being directed onto a plurality of areas of the adjacent back court of a respective one of said tennis courts and the contiguous portion of the adjacent service box and cooperating to increase the lighting intensity on the advance face of a tennis ball in flight as it approaches the ball receiving player from an opponent player; and at least certain of said floodlamps supporting means supporting more than one set of floodlamps with a selected one of said sets being directed to illuminate the adjacent end of a respective contiguous tennis court.

8. That improvement defined in claim 7 characterized in that said plurality of tennis courts are located side-by-side, and wherein one of said floodlamp supporting means is located at a pair of contiguous outer corners of each outer tennis court and supporting a set of floodlamps directed to illuminate a respective one of the contiguous ends of the adjacent tennis court, and at least one other of said floodlamp supporting means having two sets of floodlamps mounted thereon and directed to illuminate the adjacent end of a respective contiguous pair of said tennis courts.

9. That improvement defined in claim 7 characterized in that said plurality of tennis courts includes two pairs of side-by-side tennis courts arranged end-to-end, and each of said floodlamp supporting means having separate sets of floodlamps mounted thereon directed to illuminate the adjacent end of a respective one of said tennis courts.

10. That improvement in floodlighting at least one tennis court surrounded by a conventional playing area comprising:

a pair of upright supports located behind the players and adjacent a respective one of a pair of remotely spaced diagonally related corners of said playing area; and a least one set of floodlamps on each of said supports at a level normally above the line of sight of players using said court to play tennis, said floodlamps being directed onto a plurality of areas of the adjacent back court of said tennis court and onto the contiguous portion of the adjacent service box and effective to increase the lighting intensity on the advance face of a tennis ball in play as it approaches the ball receiving player.

11. That improvement in floodlighting defined in claim 10 characterized in the provision of three upright supports for use in floodlighting a pair of tennis courts having a pair of sides of their playing areas contiguous to one another, one of said supports at the corner junction of said pair of playing areas and the other two supports being at a respective one of the remote diagonally related corners of said playing areas, said one support having two sets of floodlamps thereon each directed onto the adjacent backcourt and service box of a respective one of said tennis courts and the other two supports each having a set of floodlamps directed onto the adjacent backcourt and service box of the adjacent tennis court.

* * * * *

UNITED STATES PATENT OFFICE

CERTIFICATE OF CORRECTION

PATENT NO. : 4,141,056

DATED : February 20, 1979

INVENTOR(S) : Samuel M. Neely

It is certified that error appears in the above-identified patent and that said Letters Patent are hereby corrected as shown below:

Claim 1, Col. 4, line 15, after "conventional" insert --rectangular--.

Claim 1, Col. 4, line 15, after "area" delete "playingarea" .

Signed and Sealed this

*Thirtieth* Day of *October 1979*

[SEAL]

*Attest:*

RUTH C. MASON
*Attesting Officer*

LUTRELLE F. PARKER
*Acting Commissioner of Patents and Trademarks*